United States Patent [19]

Wheeler

[11] 3,933,176

[45] Jan. 20, 1976

[54] FAIL OPERATIVE SPLIT TANDEM VALVE

[75] Inventor: Mildred S. Wheeler, Long Beach, Calif.

[73] Assignee: McDonnell Douglas Corporation, Long Beach, Calif.

[22] Filed: July 12, 1974

[21] Appl. No.: 488,036

[52] U.S. Cl. ..... 137/596; 91/411 A; 137/596.12

[51] Int. Cl.[2] ..... F15B 20/00

[58] Field of Search ..... 91/367, 384, 411 A, 413; 137/596, 596.12

[56] References Cited

UNITED STATES PATENTS

| | | | |
|---|---|---|---|
| 3,529,514 | 9/1970 | Mayo et al. | 91/411 A |
| 3,702,120 | 11/1972 | Redeker | 137/596 X |
| 3,757,817 | 9/1973 | Wheeler et al. | 137/596 |

*Primary Examiner*—Alan Cohan
*Assistant Examiner*—Gerald A. Michalsky
*Attorney, Agent, or Firm*—G. W. Finch; W. J. Jason; D. L. Royer

[57] ABSTRACT

A valve for simultaneous valving in two separate hydraulic systems, the valve having two slides with each slide being attached to a bypass driving member through caged spring cartridges. If one of the slides jams the other slide is moved by the bypass driving member in the opposite direction to the direction in which the jam occurred. The jammed system slide includes a porting which is opened by the relative movement of the bypass driving member, placing that system in a bypass condition. The other slide is not effected and remains in full control of a tandem hydraulic cylinder to which such valves are connected. If each half of the tandem cylinder is sized for full thrust capacity, there is no degradation in performance during the jammed condition.

3 Claims, 4 Drawing Figures

FAIL OPERATIVE SPLIT TANDEM VALVE

BACKGROUND OF THE INVENTION

Modern day aircraft are now of such size and/or fly at such airspeeds that power boost through the use of hydraulic actuator assemblies is required so the pilot is able to move the control surfaces of the aircraft.

Such control surface hydraulic actuator assemblies usually include a hydraulic actuator, a control valve to control the movement of the hydraulic actuator, means which feed commanded inputs to the control valve and means which feed back the actuator's position to the control valve so the hydraulic actuator is moved to and positioned in the commanded location. Unfortunately, control valves in some instances have a tendency to jam. This causes the valve spool or slide therein which normally switches the pressurized hydraulic fluid fed to the hydraulic actuator to move it, to remain in an undesirable fixed position. If unchecked, a spool jammed in a fluid transmitting position causes the hydraulic actuator and the control surface connected thereto to "runaway" to one or the other extremes of travel thereof.

Competent aircraft design and federal regulations dictate that unless a control valve jam can be shown to be extremely improbable, a jam must be protected against or the effect thereof alleviated if the jam can cause a flight control surface to runaway to an adverse position. Since the jam is probable, as aforesaid, four types of prior art valves have been developed to solve the runaway control problem.

One of these prior art control valves has dual concentric slides, each slide is designed to provide one-half of the required hydraulic flow to the hydraulic actuator and both slides operate in sequence. If a concentric slide jams near neutral approximately half the flow is available to feed the hydraulic actuator for the control of the control surface. If, on the other hand, a concentric slide jams hardover; that is, in a position to port maximum flow to the actuator to move it in one direction, both actuator cylinder pressures are ported to return and the actuator is in a bypassed condition. Not only is the dual concentric slide valve disadvantageous as causing unnecessary hydraulic flow when jammed in anything but a null position, it can jam near a null position and the jam is not detectable since up to one-half the flow is still available to make the hydraulic actuator operate normally. Since most flight conditions do not require anywhere near the full flow which would cause the dual concentric valves failure to be obvious, the jam may go undetected until the other slide therein jams. If it jams in the same direction as the first jammed slide there is a possibility of control surface runaway to a far extreme. Therefore, multiple control surfaces must be use to assure that in the event of a control surface runaway, sufficient authority is available in the other control surfaces to retain control of the aircraft.

The second prior art valve has a flow controlling slide which operates in conjunction with a caged outer sleeve. When the slide jams, the outer sleeve moves and bypasses the actuator cylinder ports.

The third prior art valve has a caged spring cartridge in the valve input drive. When the valve jams, the spring cartridge is overridden, tripping an electrical switch which, as long as electric power is available, energizes a solenoid operated cylinder bypass valve. It should be obvious that this third type prior art control valve which utilizes electric sensing means can lose its jam protection when an electronic failure such as a failed switch or the loss of the electrical system occurs. For this reason the electronic system must be highly redundant so the requirement of extreme improbability of a runaway flight control surface is met.

The fourth type is a split tandem valve as disclosed in U.S. Pat. No. 3,757,817, which has two slides in tandem attached to a driving member through caged spring cartridges. If one of the slides jams, the other is moved in the opposite direction by the feedback means thereby preventing a control surface runaway by placing the controlled tandem hydraulic cylinder in hydraulic lock.

SUMMARY OF THE INVENTION

The present fail operative, split tandem control valve has two slides, one to control each of two separate and independent hydraulic systems. Each slide is attached to a bypass driving member through preloaded caged spring cartridges. If a slide jams, control feedback means from the controlled tandem hydraulic cylinder senses the uncommanded movement of the hydraulic cylinder and moves the bypass driving member and the unjammed slide in the opposite direction to the direction in which the jam occurred to correct the positioning of the tandem hydraulic cylinder. Since the jammed slide cannot move, portions of the associated caged spring cartridge are compressed to allow relative movement between the jammed slide and the bypass driving member. This relative movement opens porting between the jammed slide and the bypass driving member to place the jammed half of the valve and its controlled half of the actuator in a bypass condition. The other slide is not affected and remains in control of the hydraulic cylinder no matter what the position of the jammed slide.

The present valve gives an aircraft designer the option of using fewer independent control systems since it remains operative with up to full authority even in the event of a jammed condition. This, of course, is not the case with the fourth type prior art tandem valve discussed heretofore which places the cylinder in hydraulic lock. The present valve has the advantage over the dual concentric slide valve (first type prior art valve) in that when a jam occurs, only one system of the tandem actuator is in a full bypass condition and the second system is still available to control the control surface at full or reduced capacity depending upon the piston area. Also, the present valve is advantageous over the first and second prior art types because if a hardover jam occurs, both halves of the tandem cylinder are not in a bypass condition therefore, one system maintains control of the surface no matter where the jam occurs. As for the third type prior art valve, the present invention is advantageous because it is fail operative, maintaining control of the surface even though a jam has occurred and thus it can be used in aircraft not having multiple segmented control surfaces, the third and fourth type prior art valves being limited to such installations.

It is therefore an object of the present invention to provide a dual control valve which can operate a tandem hydraulic cylinder up to its full capacity when a jammed condition exists in the valve.

Another object of the present invention is to provide jammed valve protection meeting FAA's special conditions for airbuses within the diameter of standard valve configurations.

Another object is to provide jam protection in a control valve without using electronics and exposed caged spring cartridges.

Another object is to provide a control valve having jammed slide protection in which a jam is detectable no matter what the position of the slide when the jam occurred including no and full flow positions.

Another object is to provide a flow control valve which cannot produce runaway of a flight control to an adverse position due to one jam therein.

Another object is to provide a jam operative, split tandem valve whose bypass driver and slide operation can be quickly and economically checked by maintenance personnel.

These and other objects and advantages of the present invention will become apparent after considering the following detailed specification which covers a preferred embodiment thereof in conjunction with the accompanying drawings wherein:

BRIEF DESCRIPTION OF THE DRAWINGS

FIG. 3 is a view similar to FIGS. 1 and 2 with one slide of the valve jammed hardover to extend, the input returned to neutral, the jammed system in a bypass condition and the unjammed system controlling the tandem hydraulic cylinder.

DESCRIPTION OF THE PRESENT EMBODIMENT

Figure 1:
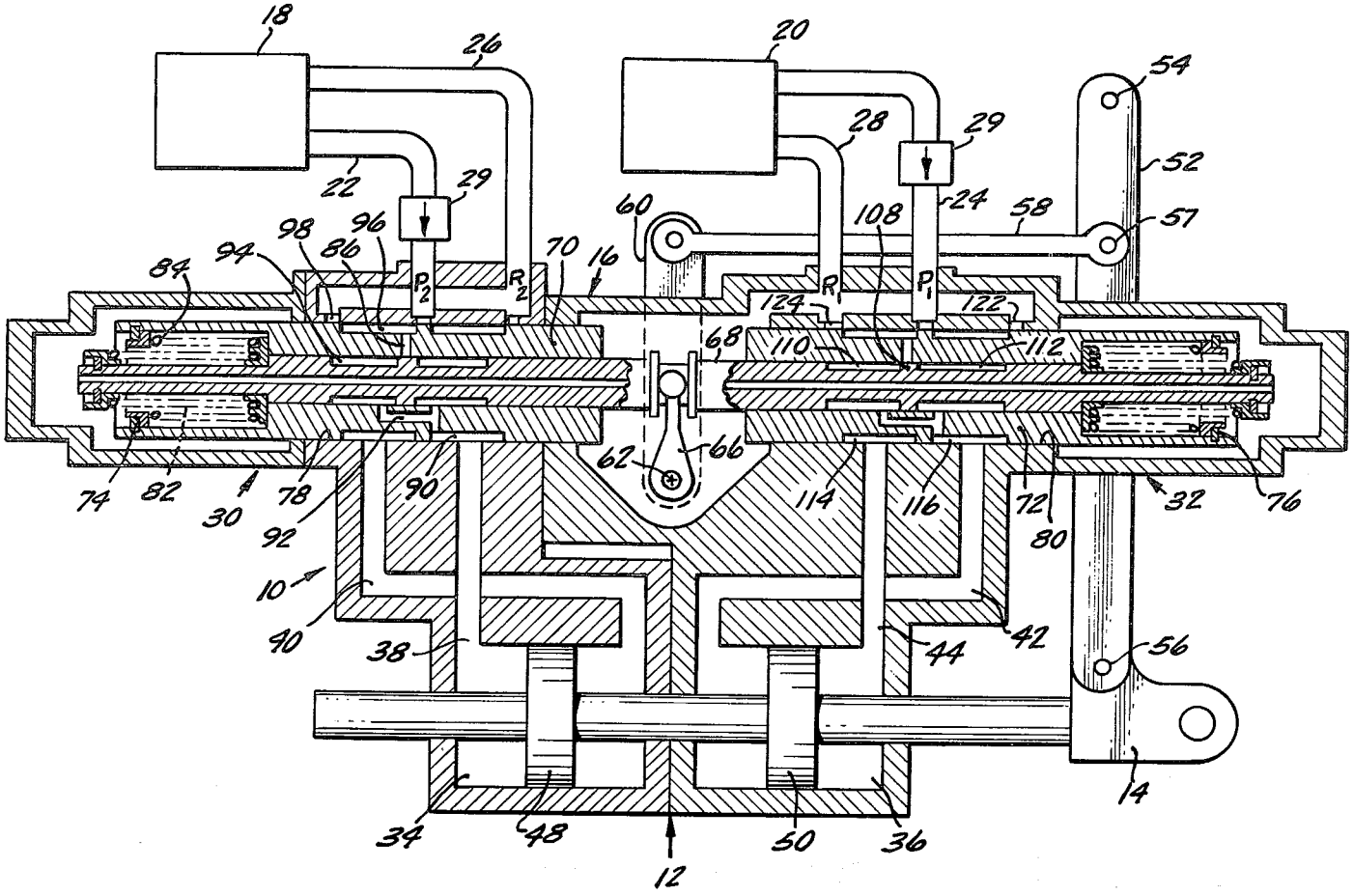
FIG. 1 is a diagrammatic representation of a hydraulic actuator assembly including the fail operative split tandem valve of the present invention.

Referring to the drawings more particularly by reference numbers, number 10 in FIG. 1 refers to a hydraulic actuator assembly for use as a control surface actuator on an aircraft. The assembly 10 includes a dual hydraulic actuator 12 whose output arm 14 provides the driving connection to the aircraft control surface (not shown) to move it. Also included in the assembly 10 is a fail operative split tandem valve 16 constructed according to the present invention. The control valve 16 controls the flow of hydraulic fluid from one or more hydraulic systems 18 and 20 which supply pressurized fluid thereto through pressure lines 22 and 24 and which receive hydraulic fluid therefrom by return lines 26 and 28 respectively. The pressure lines usually include check valves 29 which prevent fluid from returning therethrough. The hydraulic systems 18 and 20 usually include restrictor means which prevent more than a predetermined flow to and from the hydraulic actuator assembly 10. This prevents excessive hydraulic energy waste when a portion of the fail operative split tandem valve 16 is in a bypass condition.

The valve 16 has two essentially identical portions 30 and 32 which control the flow of pressurized hydraulic fluid from the hydraulic systems 18 and 20 respectively to separate chambers 34 and 36 of the actuator 12. The similar portions 30 and 32 of the control valve 16 usually operate in parallel to provide hydraulic flow through lines 38 and 40 to chamber 34 and through lines 42 and 44 to chamber 36. The chambers 34 and 36 have pistons 48 and 50, respectively, therein which are connected to drive the output arm 14. When the control valve 16 is operating normally so that both portions 30 and 32 are working in parallel, the control valve 16 causes flow toward the actuator 12 in lines 38 and 42 to extend the output arm 14 and flow toward the actuator 12 in lines 40 and 44 to retract it.

The control valve 16 causes the movement of the actuator output arm 14 in response to input commands fed to the input arm 52 at the input end 54 thereof. The input arm 52 is, in fact, a summing link with its opposite end 56 being connected to the output arm 14 of the dual hydraulic actuator 12. At a position therebetween a connection 57 is provided to an input drive link 58 whose opposite end is connected to a crank 60 which rotates about axis 62.

Figure 2:
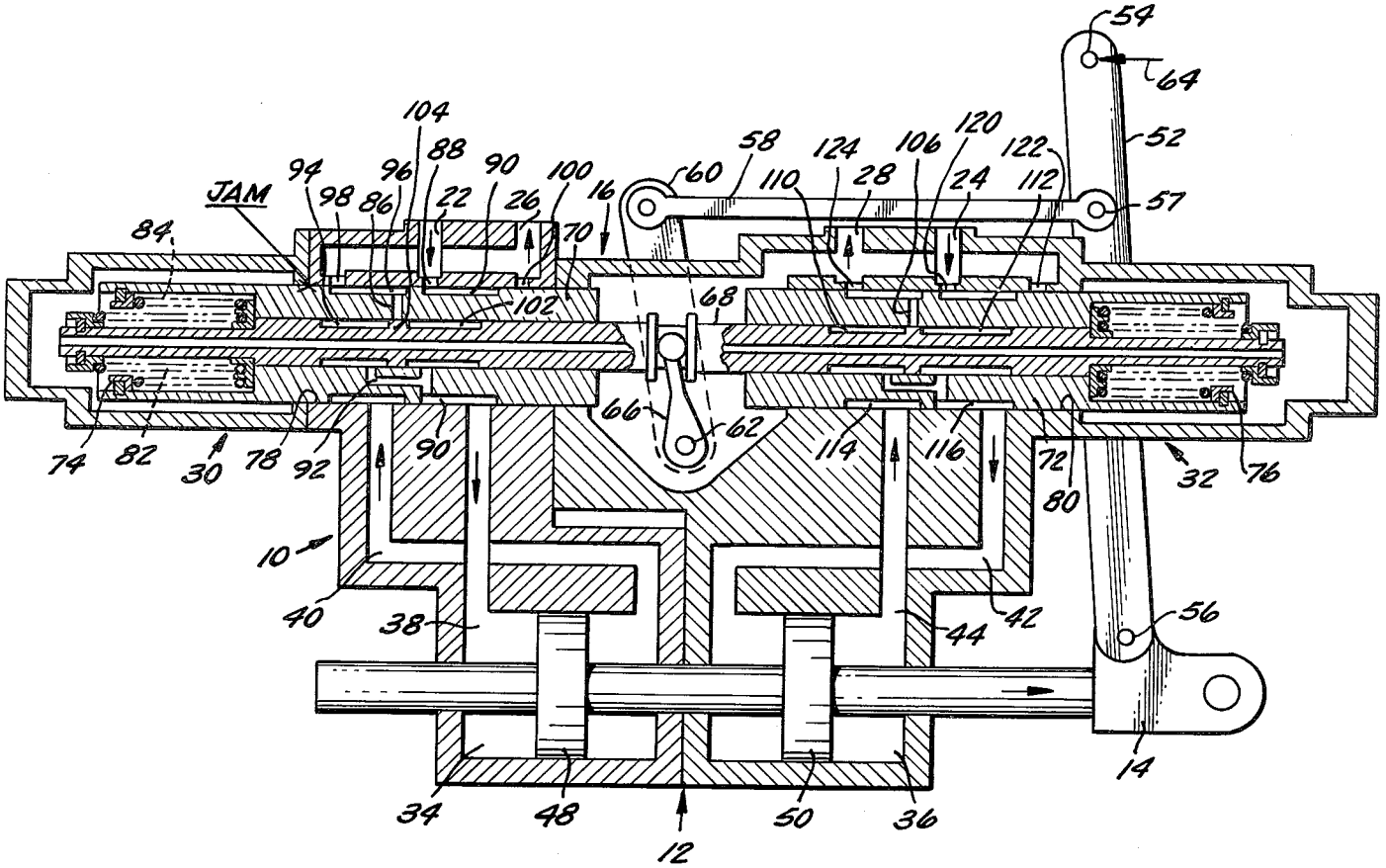
FIG. 2 is a cross-sectional view of the present valve with the jam occurring during a hardover, extend input signal thereto.

As shown in FIG. 2, an input in the direction shown by arrow 64 applied to the input end 54 of the input arm 52 moves the input arm 52 to the left, thus also moving the input drive link 58 and the crank 60 to the left. A second crank 66 is connected at the axis 62 to rotate with the crank 60 and it extends into the control valve 16 to move the bypass driving member 68 thereof. The bypass driving member 68 is connected to flow controlling valve slides 70 and 72 in the valve 16 through caged spring cartridges 74 and 76, respectively. Therefore, movement of the bypass driving member 68 normally causes corresponding movement of the slides 70 and 72 which allow flow of hydraulic fluid to the hydraulic actuator 10. In response to the flow of hydraulic fluid in the directions shown, the output arm 14 of the hydraulic actuator 12 extends and moves the connected control surface in the commanded extend direction. The output arm 14 also moves the end 56 of the input arm 52 which feeds the position thereof back through the link 58 which repositions the cranks 60 and 66 so that the bypass driving member 68 moves the valve slides 70 and 72 back to the neutral positions shown in FIG. 1. When the valve slides 70 and 72 are in their neutral or null positions, there is no further flow to the actuator 12 and it stays in the commanded position. Therefore it can be seen that normally the actuator 12 will move to and remain at the position commanded by the position of the input end 54 of the input arm 50.

It should be realized that although failure is extremely unlikely, the normal failure mode for valves such as valve 16, occurs because of a jam between the slide 70 or 72 and the cylinder 78 or 80 in which it slides. These jams are normally caused by erosion inside the valve or foreign matter transported by the hydraulic fluid which prevents easy sliding motion between the slides and the cylinder walls. In the following discussion it is assumed that a jam has occurred between the cylinder 78 and the slide 70 at the position shown in FIG. 2 and one example of how the valve 16 copes with such a jam condition is shown. It should be realized that whether slide 70 jams in the cylinder 78 or slide 72 jams in cylinder 80 and whether the jam occurs anywhere from full extend to full retract, the operation of the valve 16 will be similar with the jammed slide 70 and 72 ultimately being placed in a bypass condition and the other maintaining control of the actuator 12.

In FIG. 3 the input end 54 of the input arm 52 is shown in a position commanding that the output arm 14 of the actuator 12 return to its centered location. This returns the bypass driving member 68 to what would be its normal null position. However, because of the jam the valve slide 70 is unable to move with respect to the valve cylinder 78. The spring 82 of the caged spring cartridge 74 is compressed by the force applied to the bypass driving member 68 by the drive linkage, allowing it to be moved relative to the valve slide 70. Of course, if the relative movement between the bypass driving member 68 and the slide 70 was in the other direction, spring 84 of the caged spring cartridge 74 would be the one that is compressed. The relative movement between the slide 70 and the bypass driving member 68 opens a bypass flow path for the hydraulic fluid from the pressure line 22 to the return line 26. This bypass path exists because the movement of the bypass driving member 68 with respect to the slide 70 opens a passageway 86 which thereafter allows the hydraulic fluid to enter from line 22 through the input port 88, a first slide annulus 90, another passageway 92 through the slide 70 and an annulus 94 formed in the surface of the bypass driving member 68. From there the fluid passes through the passageway 86 and a second slide annulus 96 to a return port 98 which connects to the return line 26. It should be noted that the slide annuli 90 and 96 face the ports 88, 98 and 100 and the lines 38 and 40. The annuli are wide enough to always connect to the actuator feed lines 38 and 40 yet are just smaller than the space between the input port 88 and the return port 98 or 100 which also connects to the return line 26. This is because the annuli 90 and 96 in combination with the ports 88, 98 and 100 normally perform the valving action of the valve portion 30. The annulus 94 along with a second bypass driving member annulus 102, have a flange portion 104 formed therebetween which is just wide enough to close off the passageway 86. The annuli 94 and 102 are wide enough to assure that no matter how much the bypass driving member 68 moves away from its normal null position with respect to the slide 70, a flow path exists to bypass the jammed slide 70.

It should be noted that the flow lines 38 and 40 connected to the actuator cylinder 34 are also effectively bypassed since each is always in flow communication with the slide annuli 90 and 96 respectively. Therefore, the piston 48 within the chamber 34 is free to move when driven by the pressurized hydraulic fluid fed to chamber 36.

The hydraulic actuator 12 is, of course, controlled by the right side portion 32 of the valve 16 which continues to operate normally. As shown in FIG. 3, the valve slide 72 has moved in unison with the bypass driving member 68 so that the bypass passageway 106 which is similar to passageway 86 in portion 30 is sealed by a flange 108 between the two bypass driving member annuli 110 and 112 which are similar to the annuli 94 and 102 in the left portion 30 of the valve 16. Since the valve portion 32 is in its null position, the slide annuli 114 and 116 thereof which correspond to the slide annuli 90 and 96 on the left hand portion 30 do not allow communication of hydraulic fluid between the pressure line 24 and the return line 28, thereby maintaining the piston 50 in a fixed position within chamber 36 fixing the position of the output arm 14.

Figure 4:
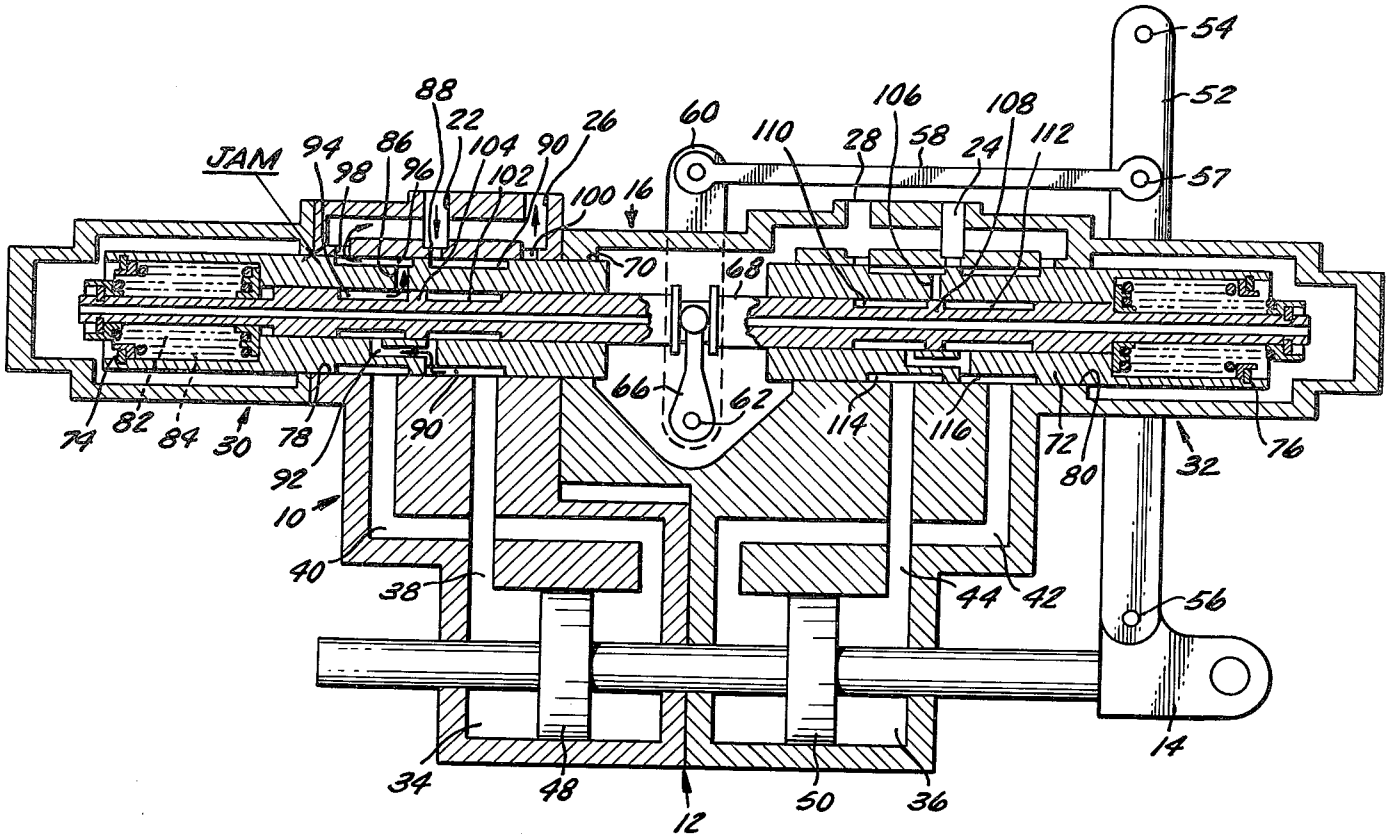
FIG. 4 is a view similar to FIGS. 1, 2 and 3 with one slide jammed hardover to extend, the input to the valve at retract, the jammed system in a bypass condition and the unjammed system controlling.
Figure 4:
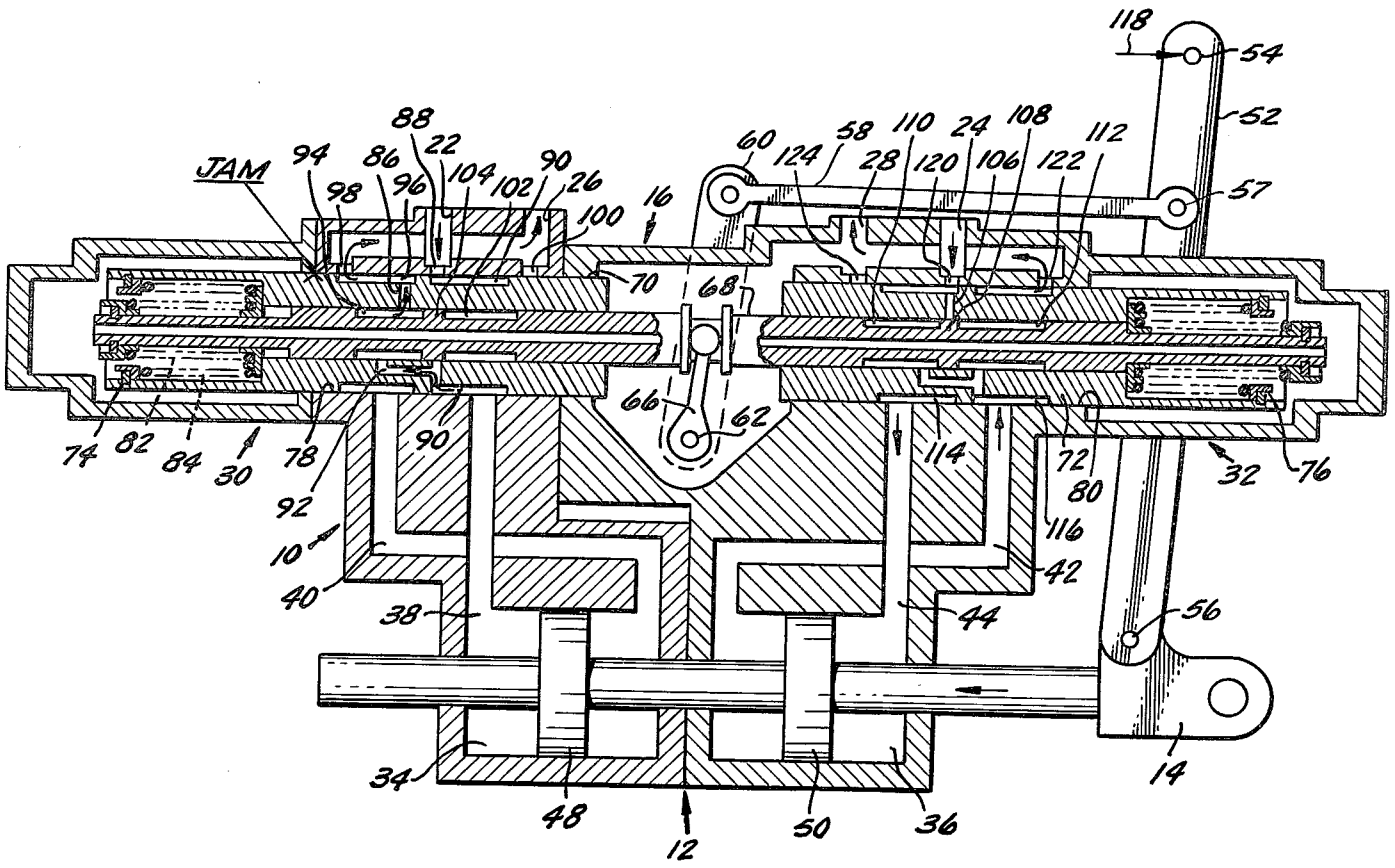

In FIG. 4 an input has been applied to the input end 54 of the input arm 52 in the direction shown by the arrow 118 to command a retraction of the output arm 14. As FIG. 4 shows, the jammed left-hand portion 30 of the valve 16 continues to bypass the chamber 34 while the right-hand portion 32 applies pressurized fluid from pressure line 24 through the pressure port

120 thereof, the slide annulus 114 and the line 44 to the chamber 36 to retract the arm 14. The opposite side of the chamber 36 is connected by line 42, slide annulus 116 and a return port 122 to the return line 28. If the output arm 14 was commanded to extend, pressurized fluid would be conducted to annulus 116 and the return flow would be conducted by means of annulus 114 to the other return port 124 and thereafter to the return line 28.

Since the valve 16 is fail operative, means must be provided to check to see if a jam exists within the valve. Although various methods such as measuring the hydraulic flow, and inspection of the spring cartridges is possible, the most convenient method is to turn off the connected hydraulic systems one at a time while exercising the assembly 10. The proper operation of the valve 16 can then be determined by observing the correspondence between the control surface position and movement with the position and movement of the input to the assembly 10.

Thus there has been shown and described a novel fail operative, split tandem valve which fulfills all of the objects and advantages sought therefor. Many changes, alterations, modifications and other uses and applications of the subject valve will become apparent to those skilled in the art after considering this specification and the accompanying drawings. All such changes, alterations, modifications and other uses which do not depart from the spirit and scope of the invention are deemed to be covered by the invention which is limited only by the claims which follow.

What is claimed is:

1. A fail operative valve for simultaneous valving in two separate systems including:

a valve housing having first and second portions, said first housing portion having an inlet for pressurized fluid, at least one outlet for fluid return and a pair of ports for feeding the fluid to and from actuator means, said second housing portion having an inlet for pressurized fluid, at least one outlet for fluid return and a pair of ports for feeding the fluid to and from actuator means;

a first valve slide positioned in said first housing portion adjacent said first housing portion inlet, outlet and ports, said first valve slide having first and second annular passageways which are the only annular passageways therein, said first and second passageways normally valving said hydraulic fluid between said first housing portion inlet, outlet and ports to operate the actuator means, said first valve slide also having a third passageway connected to said first passageway and a fourth passageway connected to said second passageway;

a second valve slide positioned in said second housing portion adjacent said second housing portion inlet, outlet and ports, said second valve slide having first and second annular passageways which are the only annular passageways therein, said first and second passageways normally valving said hydraulic fluid between said second housing portion inlet, outlet and ports to operate the actuator means, said second valve slide also having a third passageway connected to said first passageway and a fourth passageway connected to said second passsageway; and bypass driver means having a connection for mechanical input commands, first preloaded resilient means connected to move said first valve slide with said bypass driver means in response to the mechanical input commands up to a predetermined force, second preloaded resilient means connected to move said second valve slide with said bypass driver means in response to the mechanical input commands up to a predetermined force, a first pair of passageways positioned to complete a bypass flow channel between said first valve slide third and fourth passageways when the predetermined force is exceeded and said bypass driver means are moved by said mechanical input with respect to said first valve slide, and a second pair of passageways positioned to complete a bypass flow channel between said second valve slide third and fourth passageways when the predetermined force is exceeded and said bypass driver means are moved by said mechanical input with respect to said second valve slide, said first and second passageways of said first and second valve slides being positioned to always be in communication with said pair of ports for feeding fluid to and from the actuator means so a jam of one of said valve slides to said valve housing cannot produce hydraulic lock of the actuator means and said first and second valve slides having concentric inner and outer cylindrical surfaces, said first and second passageways thereof being annular channels in said outer cylindrical surfaces and said bypass driving means being positioned in contact with said inner cylindrical surfaces, said bypass driver means having at least one cylindrical outer surface, said first pair of passageways of said bypass driving means being annular channels in said cylindrical outer surface thereof, said fourth passageways of said first and second valve slides being positioned to always be in communication with said pairs of passageways in said bypass driving means and said third passageways of said first and second valve slides being positioned to be in communication with said pair of passageways in said bypass driving means only when the preload of said respective preloaded resilient means is exceeded.

2. The valve defined in claim 1 wherein said first and second preloaded resilient means are caged spring cartridges.

3. The valve defined in claim 1 wherein said valve housing has two outlets, said first and second passageways of said first and second valve slides are positioned with respect to said inlet and said outlets so that three conditions of flow are possible depending upon the position of said slides, a first with said inlets in communication with said first passageways of said slides and the outlets in communication with said second passageways of said slides, and a second with said inlets in communication with said second passageways of said slides and the outlets in communication with said first passageways of said slides, and a third preventing flow at said inlets and outlets.

* * * * *